US009125488B2

(12) United States Patent
Evangelidis

(10) Patent No.: US 9,125,488 B2
(45) Date of Patent: Sep. 8, 2015

(54) REPLACEABLE FRONT PANEL SYSTEM FOR USE WITH STORAGE MODULES

(75) Inventor: Andrew Evangelidis, Pierrefonds (CA)

(73) Assignee: ALEXIA HOLDINGS INC., Quebec (CA)

( * ) Notice: Subject to any disclaimer, the term of this patent is extended or adjusted under 35 U.S.C. 154(b) by 0 days.

(21) Appl. No.: 13/174,110

(22) Filed: Jun. 30, 2011

(65) Prior Publication Data

US 2012/0223628 A1 Sep. 6, 2012

Related U.S. Application Data

(60) Provisional application No. 61/447,908, filed on Mar. 1, 2011.

(51) Int. Cl.

| | |
|---|---|
| ***A47B 88/00*** | (2006.01) |
| *E06B 3/70* | (2006.01) |
| *A47B 95/00* | (2006.01) |

(52) U.S. Cl.

CPC ..... *A47B 88/0044* (2013.01); *A47B 88/0051* (2013.01); *A47B 88/0055* (2013.01); *A47B 95/00* (2013.01); *E06B 3/7015* (2013.01); *Y10T 29/49826* (2015.01)

(58) Field of Classification Search

CPC ..... E06B 3/7001; E06B 3/822; E06B 3/7015; E06B 2003/7023; E06B 2003/7025; A47B 88/0055; A47B 88/0051; A47B 88/0044; A47B 47/03; A47B 47/042; A47B 95/00

USPC ..... 312/348.1, 384.2, 348.3, 348.4, 348.6, 312/265.5, 265.6, 204, 257.1, 405.1; 49/501, 463, 465, 466; 52/784.1–784.16

See application file for complete search history.

(56) References Cited

U.S. PATENT DOCUMENTS

| | | | | | |
|---|---|---|---|---|---|
| 1,352,002 | A | * | 9/1920 | Jones | 312/348.2 |
| 1,630,100 | A | * | 5/1927 | Whittier | 52/479 |
| 2,708,294 | A | * | 5/1955 | Saunders | 312/405 |
| 3,179,480 | A | * | 4/1965 | Brinker | 312/348.4 |
| 3,334,464 | A | * | 8/1967 | Charles | 52/784.15 |
| 3,389,033 | A | * | 6/1968 | Ullman, Jr. | 156/216 |
| 3,393,423 | A | * | 7/1968 | Adams | 16/444 |
| 3,599,703 | A | * | 8/1971 | Mennuto et al. | 160/90 |
| 3,603,659 | A | * | 9/1971 | Rothenberg et al. | 312/265.1 |
| 3,731,035 | A | * | 5/1973 | Jarvis et al. | 219/740 |
| 3,786,171 | A | * | 1/1974 | Shira | 174/504 |
| 3,855,994 | A | * | 12/1974 | Evans et al. | 126/198 |
| 4,087,143 | A | * | 5/1978 | Barnard et al. | 312/329 |
| 4,536,990 | A | * | 8/1985 | Siegrist et al. | 49/501 |
| 4,922,674 | A | * | 5/1990 | Thorn | 52/309.15 |
| 5,335,605 | A | * | 8/1994 | Drabczyk | 108/153.1 |
| 5,423,605 | A | * | 6/1995 | Liu | 312/265.6 |
| 5,536,060 | A | * | 7/1996 | Rashid et al. | 296/146.6 |
| 5,909,937 | A | * | 6/1999 | Jenkins et al. | 312/405.1 |

(Continued)

*Primary Examiner* — Daniel J Troy
*Assistant Examiner* — Hiwot Tefera
(74) *Attorney, Agent, or Firm* — Patterson & Sheridan, L.L.P.

(57) ABSTRACT

A replaceable front panel system for use with a storage module, including a chassis defining a structural configuration of the front panel system, and a removable covering skin configured to at least in part surround the chassis, the removable covering skin defining one or more exterior surfaces of the front panel system. Also provided is a kit for customizing the appearance of a door or drawer front for a storage cabinet module comprising a covering skin configured to at least in part surround a chassis of the door or drawer front, and optionally, an installation tool, and a method for installing the covering skin onto a chassis.

8 Claims, 11 Drawing Sheets

(56) References Cited

U.S. PATENT DOCUMENTS

| | | | | |
|---|---|---|---|---|
| 6,295,787 | B1 * | 10/2001 | Lee | 52/784.15 |
| 6,676,187 | B1 * | 1/2004 | Miskech et al. | 296/50 |
| 6,736,470 | B2 * | 5/2004 | Manke et al. | 312/228 |
| D498,211 | S * | 11/2004 | Thibault | D13/155 |
| 6,948,788 | B1 * | 9/2005 | Tai | 312/348.4 |
| 6,961,988 | B2 * | 11/2005 | Koons | 29/525.11 |
| 7,208,686 | B1 * | 4/2007 | Chen et al. | 174/561 |
| 7,275,398 | B2 * | 10/2007 | Kim et al. | 68/3 R |
| 8,230,647 | B2 * | 7/2012 | Cho et al. | 49/501 |
| 2002/0008448 | A1 * | 1/2002 | Jung | 312/228 |
| 2003/0020384 | A1 * | 1/2003 | Bush et al. | 312/348.4 |
| 2004/0108318 | A1 * | 6/2004 | Wang | 220/345.2 |
| 2008/0129173 | A1 | 6/2008 | Freeberg et al. | |
| 2008/0224586 | A1 | 9/2008 | Yamada | |

* cited by examiner

REPLACEABLE FRONT PANEL SYSTEM FOR USE WITH STORAGE MODULES

CROSS-REFERENCE TO RELATED APPLICATIONS

This application claims benefit of U.S. provisional patent application Ser. No. 61/447,908, filed Mar. 1, 2011, which is herein incorporated by reference.

FIELD OF THE INVENTION

The present invention pertains to the field of customizable storage modules.

BACKGROUND

U.S. Patent Publication No. 2008/0129173, to Freeberg et al., discloses a drawer front including a removable decorative skin that is configured to be repeatedly removed and installed on the drawer front. Co-acting connection features on the drawer front and the skin releasably retain the skin to the drawer front.

U.S. Patent Publication No. 2008/0224586, to Yamada, discloses planar decorative sheets or "skins" which are attachable to the outwardly facing vertical surfaces of filing cabinet drawers. These skins may fully or partially cover the outwardly facing surface of the filing cabinet drawers, and may be textured or smooth, and they may be colored in one or more different colors. Further, the skins may have one or more design features that are visible in the workplace. However, as these decorative sheets are attachable on the outwardly facing surface, the aesthetic appearance of the cabinet drawers is diminished.

There remains a need for a new and readily replaceable front panel system for use with storage modules.

This background information is provided to reveal information believed by the applicant to be of possible relevance to the present invention. No admission is necessarily intended, nor should be construed, that any of the preceding information constitutes prior art against the present invention.

SUMMARY OF THE INVENTION

An object of the present invention is to provide a replaceable and optionally customizable front panel system for use with a storage cabinet module. In accordance with an aspect of the present invention, there is provided a replaceable and optionally customizable front panel system including: a) a chassis defining a structural configuration of the front panel system; and b) a removable covering skin configured to at least in part surround the chassis, the removable covering skin defining one or more exterior surfaces of the front panel system. The front panel system can be used with storage cabinet modules.

In accordance with another aspect of the present invention, there is provided a kit for customizing the appearance of a door or drawer front for a storage cabinet module, comprising a covering skin configured to at least in part surround a chassis of the door or drawer front; and optionally, an installation tool configured to engage an end of the covering skin to temporarily deform the skin to facilitate installation of the skin on the chassis or removal of the skin from the chassis.

In accordance with another aspect of the present invention, there is provided a method for installing a covering skin onto a chassis, comprising the steps of: providing a chassis comprising a back panel, a first side panel, a second side panel, a top panel and a bottom panel; providing a covering skin, wherein the covering skin is longer than a width of the chassis and comprises first and second wrap-around portions; engaging the first wrap-around portion of the covering skin around the first side panel of the chassis; and deforming the covering skin to facilitate engagement of the second wrap-around portion of the covering skin around the second side panel of the chassis.

DETAILED DESCRIPTION OF THE INVENTION

Definitions

Unless defined otherwise, all technical and scientific terms used herein have the same meaning as commonly understood by one of ordinary skill in the art to which this invention belongs.

The present invention provides a replaceable front panel system for use with a storage module including a chassis and a removable covering skin configured to at least in part surround the chassis, the removable covering skin defining one or more exterior surfaces of the front panel system. In one embodiment, the front panel system is configured for use as a drawer front. In another embodiment, the front panel system is configured for use as a cabinet door.

The removable covering skin is configured to be easily removed from the chassis and replaced with a different covering skin, according to configuration requirements, or requirements of the user or the like. For example, the user may choose to change the color of the cabinet assembly, or introduce additional aesthetic features. Alternatively, the user may want to replace a single covering skin having an aesthetically damaged appearance.

The present invention is described for use with utility storage cabinets, however, it should be understood that this is for exemplary purposes only and the invention can be applied to a wide variety of applications which employ front panel systems, for example, doors or drawer fronts or the like, for which customization or ready replacement is desirable.

The front panel system is designed for convenient removal from the storage module. Additionally, the exterior covering skin of the front panel system can easily be removed and replaced by a consumer in an after-market environment.

Chassis

The chassis of the front panel system forms the shape of the door or drawer front, providing the supporting body upon which the removable covering skin is positioned. The chassis is configured in any size or shape suitable for use as a door or drawer front as required by the cabinet system, as the profile of the chassis forms the general shape of the door or drawer front.

Figure 1:
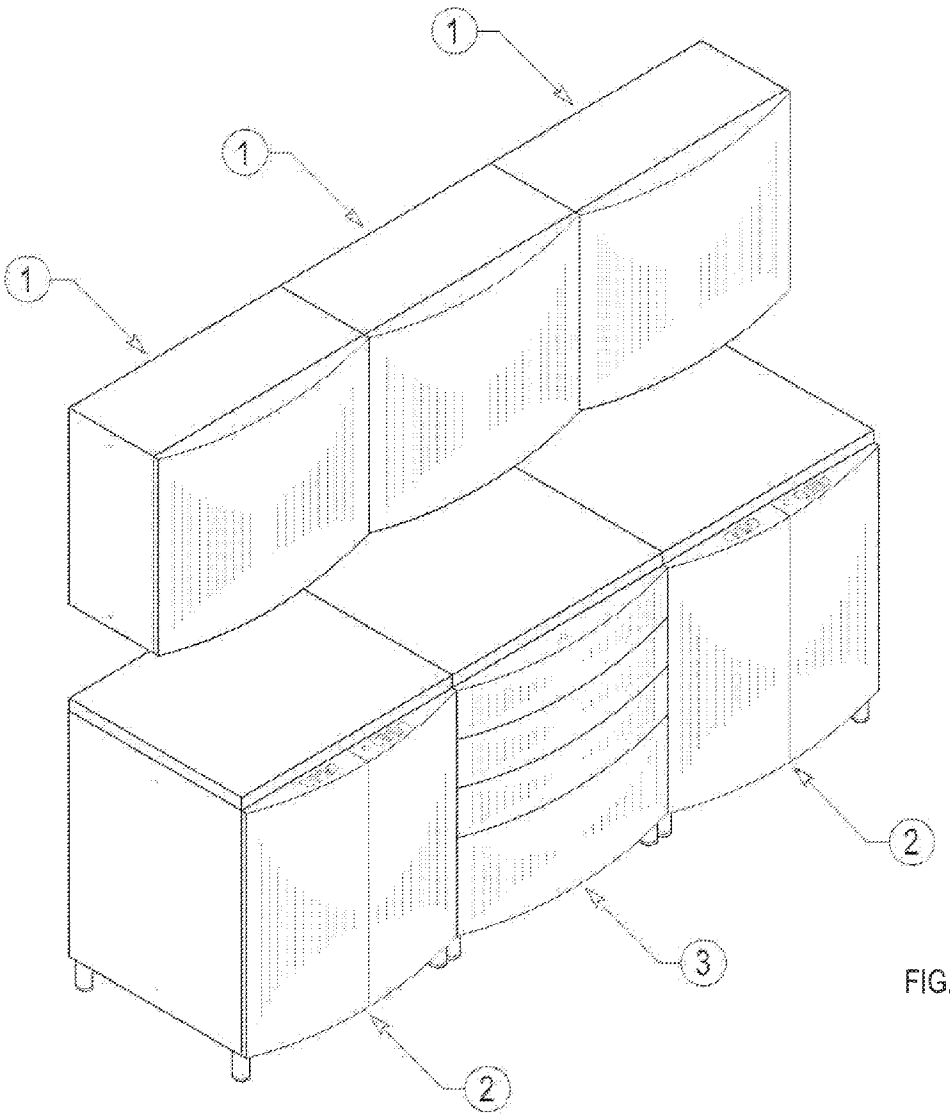
FIG. 1 illustrates an isometric assembly view of a cabinet module assembly comprising front panel systems in accordance with embodiments of the present invention.
Figure 1A:
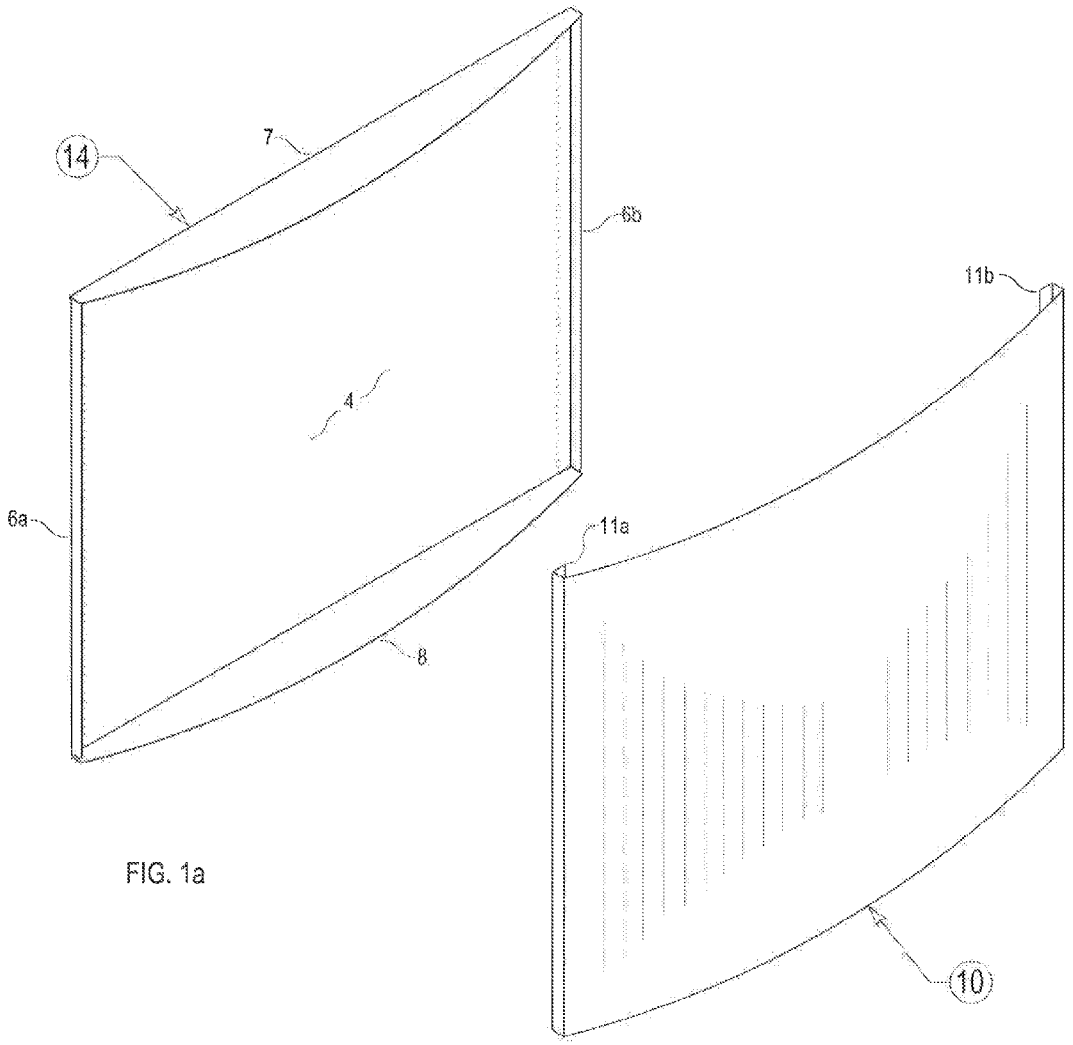
FIG. 1*a* illustrates an isometric view of a chassis and a covering skin component of a front panel system in accordance with embodiments of the present invention.

Referring to FIG. 1*a*, there is illustrated a chassis and a covering skin of a front panel system in accordance with embodiments of the present invention. In this embodiment, the chassis 14 is generally formed of back panel 4, two side panels 6*a*, 6*b*, top panel 7, and bottom panel 8. The two side panels, the top panel and the bottom panel together define an open interior, and their forward edges define the outer perimeter of a front face of the chassis. The removable covering skin 10 is configured to cover at least the front face, and the left and right sides of the chassis, thereby forming the outward face of the front panel system.

In some embodiments, the top panel and the bottom panel each have a non-rectangular shape. For example, where the top and bottom panels form a curved arc along their outwardly facing edges, the covering skin, when in place, conforms to these edges and forms a contoured front face. It is also within the scope of the present disclosure to provide front panel systems having planar front faces, as well as non-planar, or curvilinear profiles. In such embodiments, the covering skin is provided to conform to the profile of the top and bottom panels.

The chassis is manufactured from materials including, but not limited to, metal, alloy combinations, plastic, fibre-based resin materials (fiberglass), wood, stainless-steel, aluminum, and lacquered carbon fibre.

In some embodiments, the back panel is embossed to provide additional structural rigidity where desired.

In some embodiments, the chassis further comprises a handle, a door pull, or the like, located in the top or bottom panel.

Figure 1B:
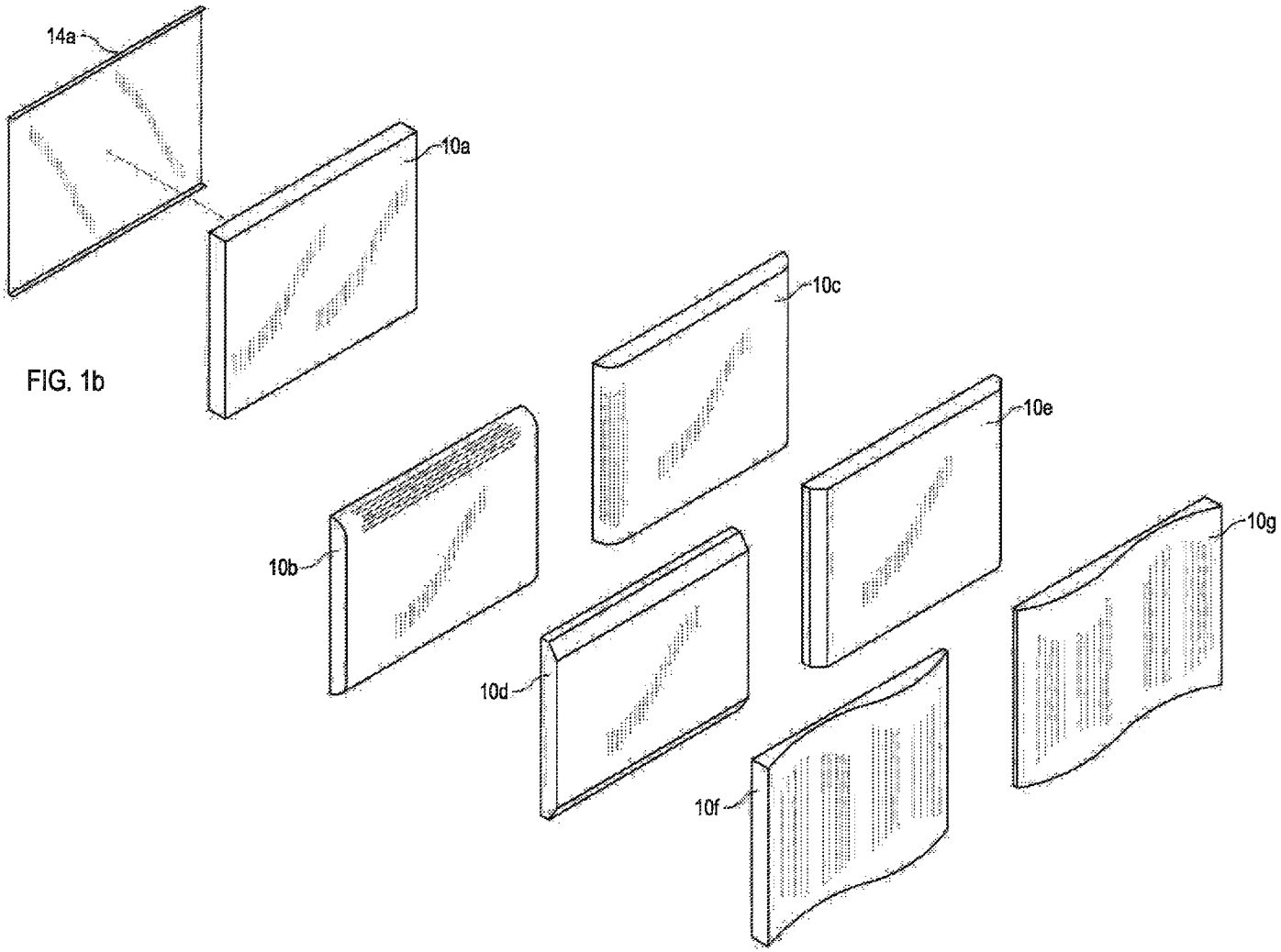
FIG. 1*b* illustrates an isometric view of the chassis and covering skin components of a front panel system in accordance with embodiments of the present invention.

In some embodiments, the chassis is formed of a back panel and two side panels, with no top or bottom panel. In other embodiments (as shown in FIG. 1*b*), the chassis 14*a* is formed of a back panel, a top panel and a bottom panel, with no side panels. These alternative configurations are within the scope of the present invention. The chassis need only provide the structural elements required to form the shape of the door or drawer front, and to provide the supporting body upon which the removable skin is positioned.

Removable Covering Skin

The front panel system comprises a removable covering skin, which is provided in various colors, materials & textures, according to the personal choice of the cabinet module owner. For example, the covering skin allows the user to change the color of the cabinet module, or introduce additional aesthetic features to or otherwise modify its appearance. Alternatively, the user may want to replace a single covering skin having an aesthetically damaged appearance.

The removable skin 10 is configured to at least in part surround the chassis 14, and form at least the front face of the front panel system. The removable covering skin is manufactured from materials including, but not limited to, painted carbon steel, painted perforated carbon steel, stainless-steel, aluminum, lacquered and natural carbon fibre, plastic, fiberglass, synthetic and semi-synthetic woven fabric materials, and wood veneers.

The removable covering skin is longer than a width of the chassis and comprises a wrap-around portion which extends around the side edges of the chassis to cover at least the two side panels of the chassis. With reference to the embodiment depicted in FIG. 1*a*, the wrap-around portions 11*a*, 11*b* of the skin extends around the two side panels of the chassis and covers at least a portion of the back panel. FIG. 1*b* depicts alternative embodiments 10*a-g* of the replaceable covering skin, all of which fall within the scope of the present invention.

It is understood that for those embodiments wherein the material used has limited flexibility and will not deform readily without cracking or causing damage to the covering skin during installation or removal (for example, carbon fibre reinforced polymers), the skin is configured to wrap only around the two side panels without extending around to the back panel.

The removable covering skin is retained on the chassis via attachment means including, but not limited to, screws, hook and loop fasteners, magnets and adhesive. It is also within the scope of the present disclosure to retain the removable covering skin on the chassis via resilient bias, i.e., wherein no additional attachment means are necessary, and the covering skin is configured to clamp the chassis, thereby retaining itself in the desired position. In some embodiments, multiple attachment means configurations can be used to retain the covering skin on the chassis, for example, resilient bias and screws.

As discussed above, the covering skin, when in place, conforms to the profile of the top and bottom panels of the chassis, thereby forming a front face having the desired contour.

Optional Reinforcement Core

In some embodiments, the front panel system comprises a reinforcement core 12. The reinforcement core is configured to fit into the open interior of the chassis 14, for example, formed by the two side panels, and the top and bottom panels, thereby providing additional structural rigidity to the chassis. The core also provides structural support to the covering skin when installed on the chassis.

The reinforcement core is manufactured from lightweight yet sturdy materials. For example, the core may be formed from materials including, but not limited to, expanded polystyrene, expanded polypropylene, injected polyurethane, natural or synthetic cork, plastic, fiberglass, and wood.

The core is placed into the chassis, and is optionally attached using an adhesive. In some embodiments, the core is held in place by screws, bolts, rivets, or the like. In some embodiments, the core is held in place by frictional fit. In some embodiments, the core is injected with liquid polyurethane foam into the cavity after attaching the removable covering skin.

Means for Attaching Panel System to Cabinet Module

The front panel system further comprises a means for attachment to the cabinet module.

The front panel system can be used as a door for an overhead reach-in type cabinet module, or as a door for an upright type cabinet module. Alternatively, the front panel system can be used as a drawer front. In each of these embodiments, it is understood that the front panel system is attached to the cabinet module using appropriate attachment means. In the embodiments wherein the panel system forms a door, appropriate attachment means include, but are not limited to, hinges and flap fittings. Where the panel is provided as a door for an overhead reach-in type cabinet, the attachment means may also optionally comprise a door lift assist device configured to assist in the opening of the door and a door stay to hold the door in an open position.

Kit

In one embodiment, the removable covering skin is provided to the consumer in the form of a kit for customizing the appearance of the door or drawer front. Such a kit comprises the skin, and optionally includes an installation tool for facilitating installation of the skin onto the chassis or removal of the skin from the chassis. This tool is configured to engage an end of the skin, allowing a user to temporarily deform the skin away from the chassis.

In some embodiments, the kit comprises instructions for installation of the covering skin on the chassis. In some embodiments, the kit comprises all hardware required for installation.

Method of Installation

The covering skin is installed onto the chassis by first engaging one of the wrap-around portions of the covering skin around one of the side panels of the chassis. The covering skin is then deformed to facilitate engagement of the other wrap-around portion of the skin around the second side panel of the chassis. An optional tool may be employed to facilitate the deformation step, particularly for those covering skin materials having a sufficient stiffness or rigidity that manipulation by hand would be difficult.

In one embodiment, the method of installation includes a step of securing the covering skin to the chassis using suitable attachment means.

The invention will now be described with reference to specific examples. It will be understood that the following examples are intended to describe embodiments of the invention and are not intended to limit the invention in any way.

EXAMPLES

Example 1

FIG. 1 is an isometric assembly view of a storage cabinet module assembly comprising three overhead reach-in cabinet modules 1, two upright cabinet modules 2 and one upright drawer module 3. Each of the cabinet modules is shown with doors and drawer fronts having removable covering skins in accordance with an embodiment of the present invention.

Example 2

Figure 2:
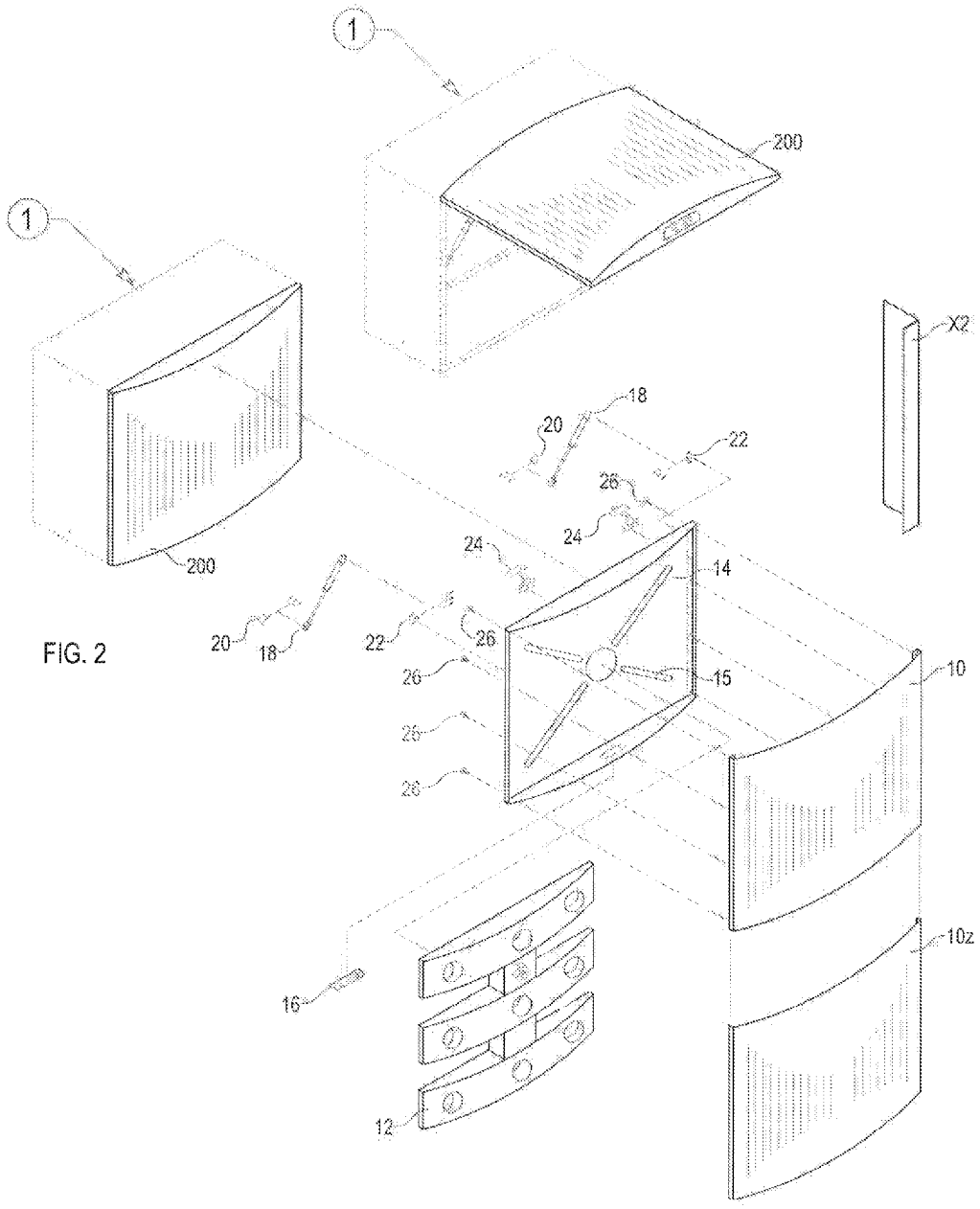
FIG. 2 illustrates an exploded isometric view of overhead reach-in cabinet module comprising a front panel system in accordance with embodiments of the present invention.

FIG. 2 is an exploded isometric view illustrating an overhead reach-in cabinet module having a full-arc door formed from front panel 200. The overhead reach-in cabinet module is shown with contoured front panel 200 in both open and closed positions. Covering skin 10 is installed onto door chassis 14 to form assembled front panel 200. Door chassis 14 is shown with optional embossed deformations 15 on the back panel for structural rigidity. Front panel 200 is attached to the cabinet module using hinge assembly 24. Door lift-assist device 18 is also provided to assist and maintain door opening functionality via top & bottom retaining brackets 20 & 22. Fastening screws 26 are used to attach covering skin 10 to the door chassis 14. Optional tool or handling device X2 is provided to temporarily deform the right-side edge of the contoured front panel. The front panel system of FIG. 2 employs reinforcement core 12 shaped and sized to fit into the open interior of chassis 14. Door pull 16 is shown incorporated into the bottom panel of the chassis.

FIG. 2 also depicts covering skin 10Z which is configured to wrap around the front and two side panels without extending around to the back panel.

Example 3

Figure 3:
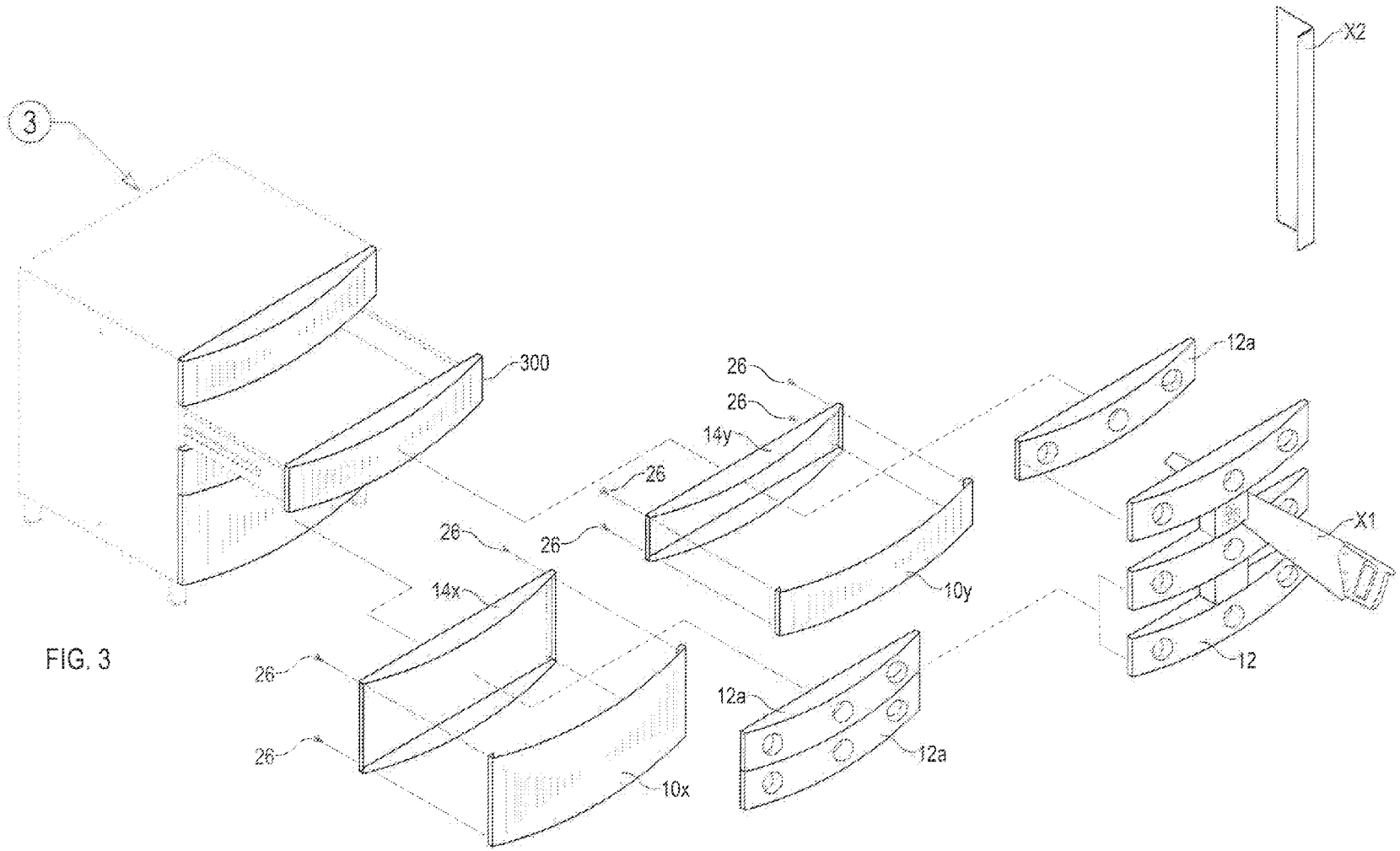
FIG. 3 illustrates an exploded isometric view of the upright drawer module comprising a front panel system in accordance with embodiments of the present invention.

FIG. 3 is an exploded isometric view of the upright drawer module components. The upright drawer module is shown with drawers in open and closed positions. The drawer fronts are formed from front panel 300. Covering skin 10*y* is installed onto chassis 14*y* to form assembled front panel 300. The front panel system of FIG. 3 employs reinforcement core 12*a* shaped and sized to fit into the open interior of chassis 14*y*. Reinforcement core 12*a* is formed by modifying the reinforcement core 12 into smaller sectional components using tool or cutting device X1. Fastening screws 26 are used to attach covering skin 10*y* to the door chassis 14*y*. Optional tool or handling device X2 is provided to temporarily deform the right-side edge of the contoured front panel. FIG. 3 also depicts a drawer embodiment formed with a larger front panel, wherein skin 10*x* is installed onto chassis 14*x*, and which employs two reinforcement cores 12*a*.

Example 4

Figure 4:
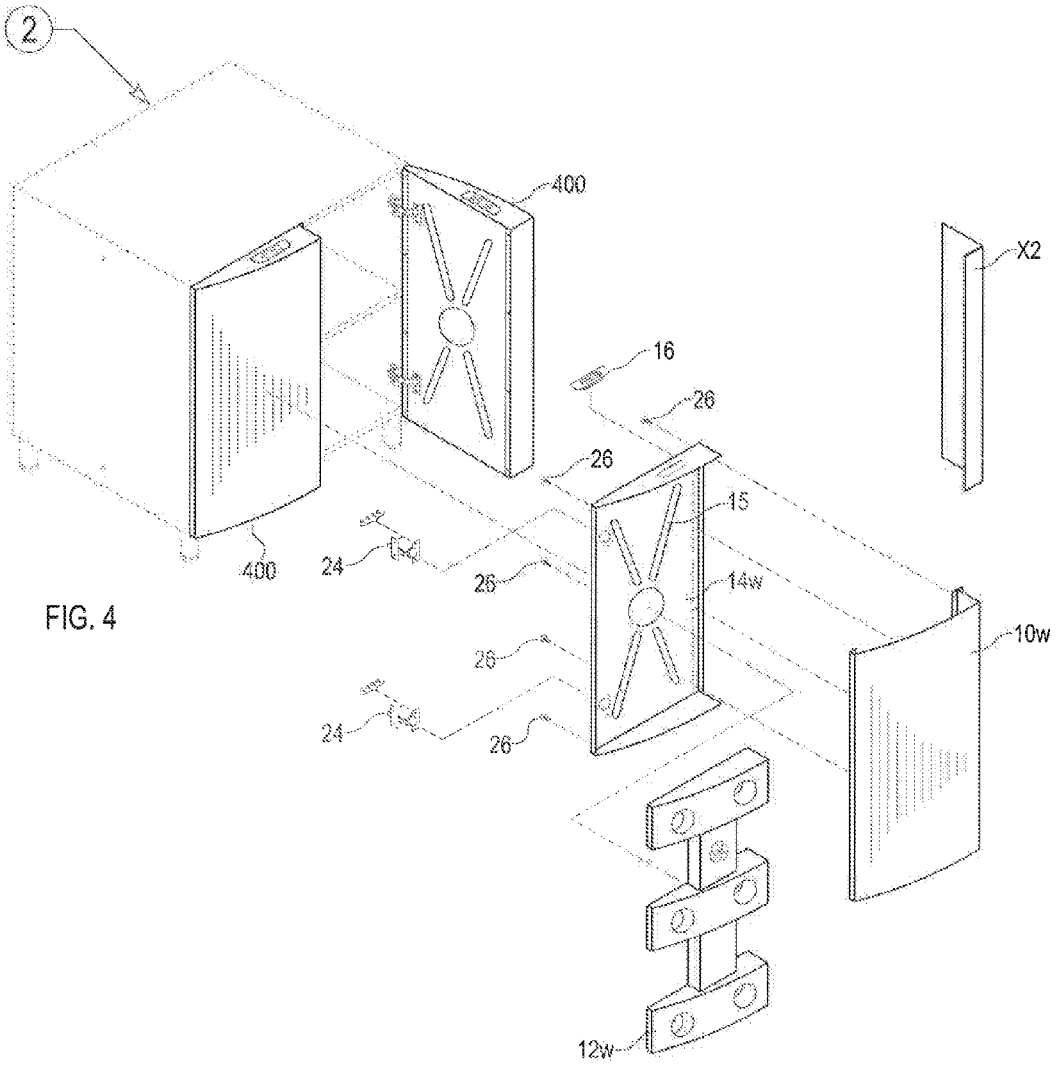
FIG. 4 illustrates an exploded isometric view of the upright cabinet module comprising a front panel system in accordance with embodiments of the present invention.

FIG. 4 is an exploded isometric view of the upright cabinet module components having partial-arc doors, each formed from front panel 400. The upright cabinet module is shown with contoured front panel 400 in open and closed positions. Covering skin 10*w* is installed onto door chassis 14*w* to form assembled front panel 400. Door chassis 14*w* is shown with optional embossed deformations 15 on the back panel for structural rigidity. Front panel 400 is attached to the cabinet module using hinge assembly 24. Fastening screws 26 are used to attach covering skin 10*w* to the door chassis 14*w*. Optional tool or handling device X2 is provided to temporarily deform the right-side edge of the contoured front panel. The front panel system of FIG. 4 employs reinforcement core 12*w* shaped and sized to fit into the open interior of chassis 14*w*. Door pull 16 is shown incorporated into the top panel of the chassis.

Example 5

Figure 5A:
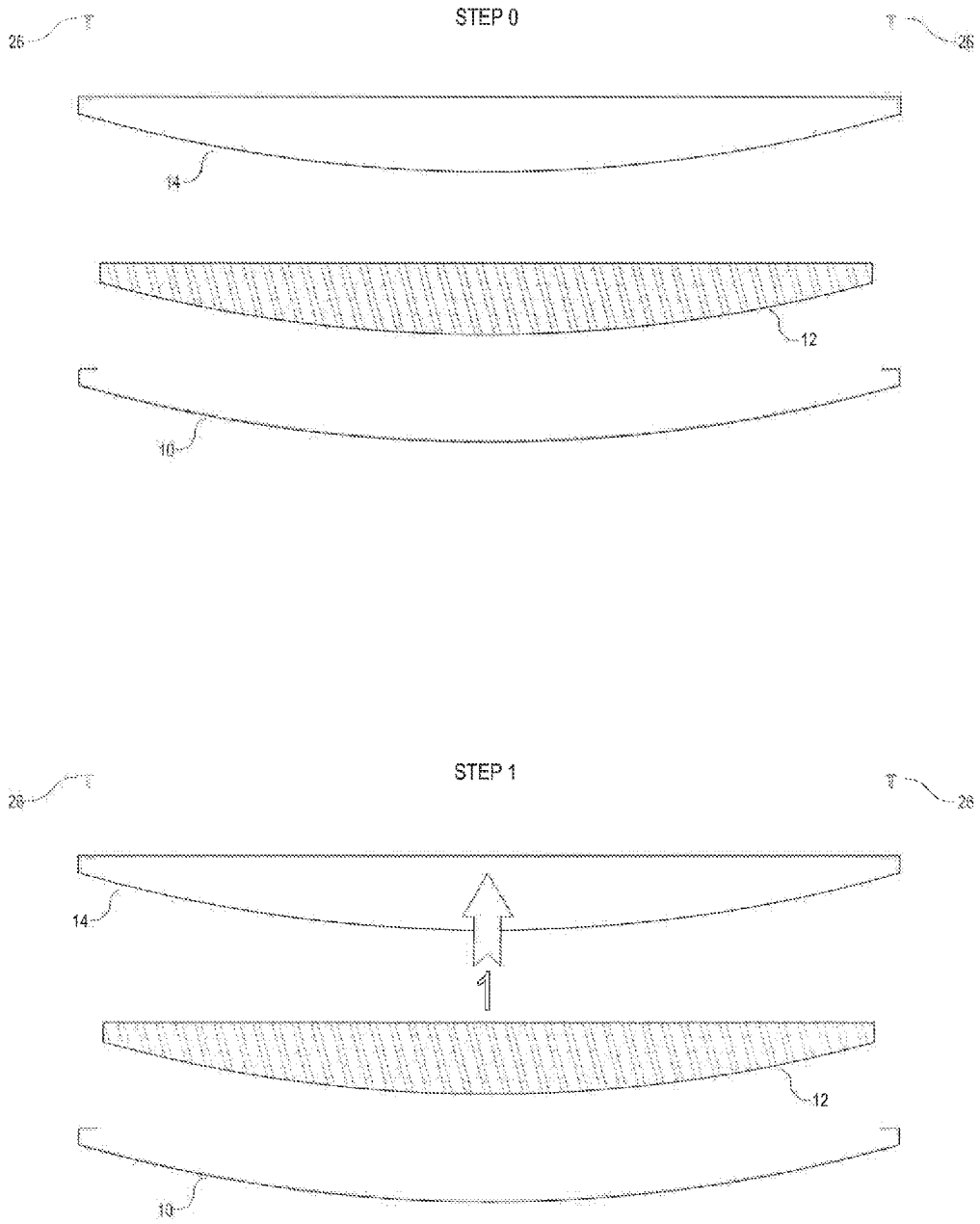
FIGS. 5*a* to 5*c* illustrate cross-sectional views of a front panel system in accordance with embodiments of the present invention during a step-wise installation process.

FIG. 5*a* illustrates the step-wise assembly of the covering skin to the chassis. Reinforcement core 12 is attached to door chassis 14 in step 1. Steps 2 through 7 depict installation of skin 10 onto door chassis 14, using a cyclic or "figure-8" motion starting from the left-side and terminating on the right-side. Optional tool X2 is used to assist in the deformation of the covering skin around the side edges of the chassis. Fastening screws 26 are installed to retain covering skin 10 to door chassis in a completed and assembled state.

Step-by-Step Method of Assembly of Covering Skin to Door/Drawer Chassis

Figure 8:
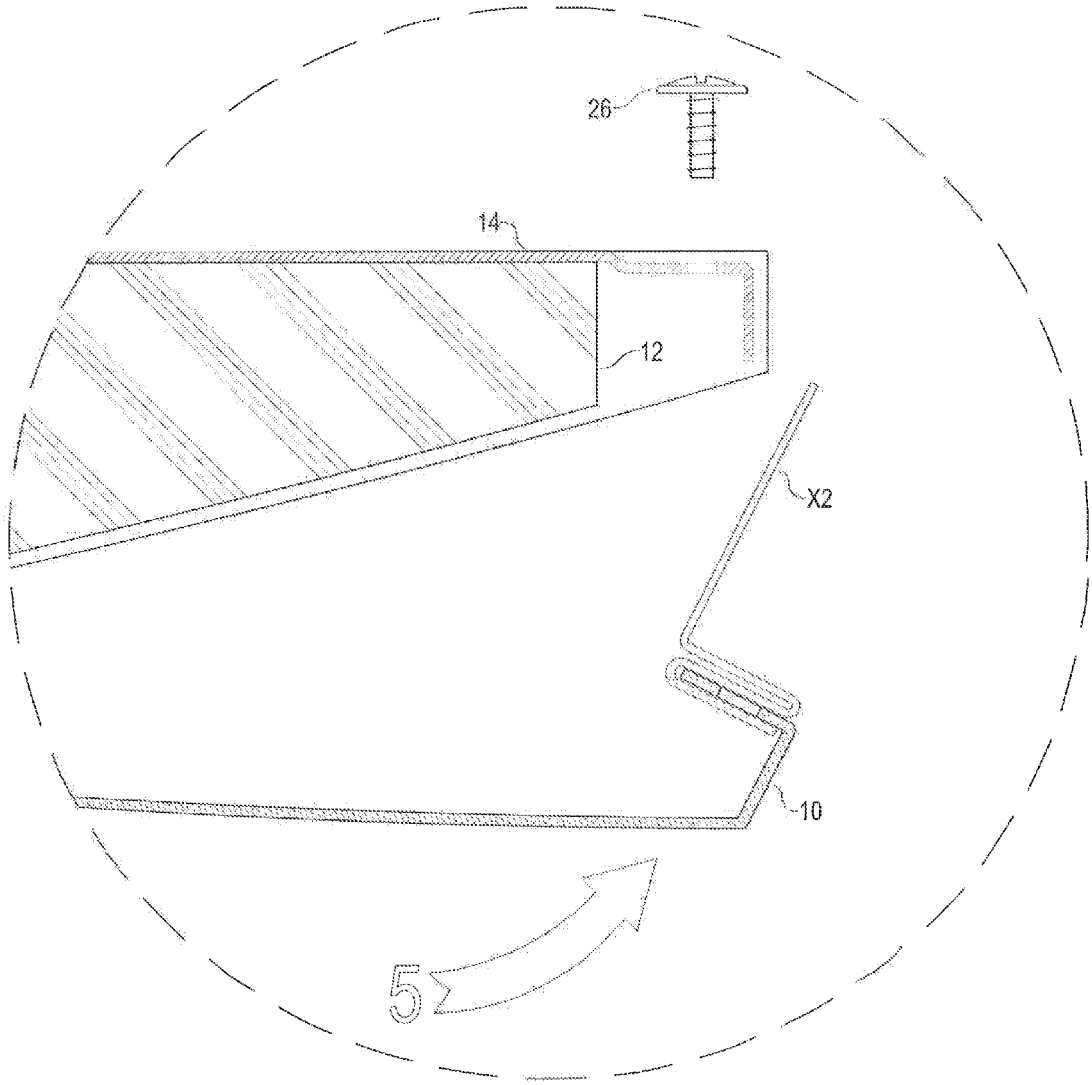
FIG. 8 illustrates an enlarged view of the step 5 of FIG. 5.

- Step 0 shows an exploded top view of all components of the front panel system that are required to assemble a typical covering skin to a door or drawer chassis.
- Step 1 shows the attachment of the reinforcement core 12 to the door/drawer chassis 14.
- Step 2 shows the commencement of the cyclic or "figure-8" motion required to attach the left-side edge of the covering skin 10 to the left-side of chassis 14.
- Step 3 shows the parked position of the left-side edge of the covering skin 10 to the left-side of the door/drawer chassis 14 using fastening screw 26 to secure same.

Step 4 shows the manner in which the covering skin 10 must be manipulated by temporarily deforming same by applying pressure to outwardly curved apex thus elongating the overall width by creating a linear form.

Step 5 shows the continued cyclic motion required to attach the right-side edge of the covering skin 10 to the right-side of the door/drawer chassis 14 using optional tool X2 while reinforcement grid 12 structurally maintains the overall contour of the covering skin 10.

Step 6 shows the parked position of the right-side edge of the covering skin 10 to the right-side of the door/drawer chassis 14 using fastening screw 26 to secure same.

Step 7 shows the assembly of the covering skin 10 to the door/drawer chassis 14 in a completed and assembled state, Disassembly of the front panel system, and removal of the covering skin from the chassis is carried out by performing steps 2 to 7 in reverse order.

Figure 5B:
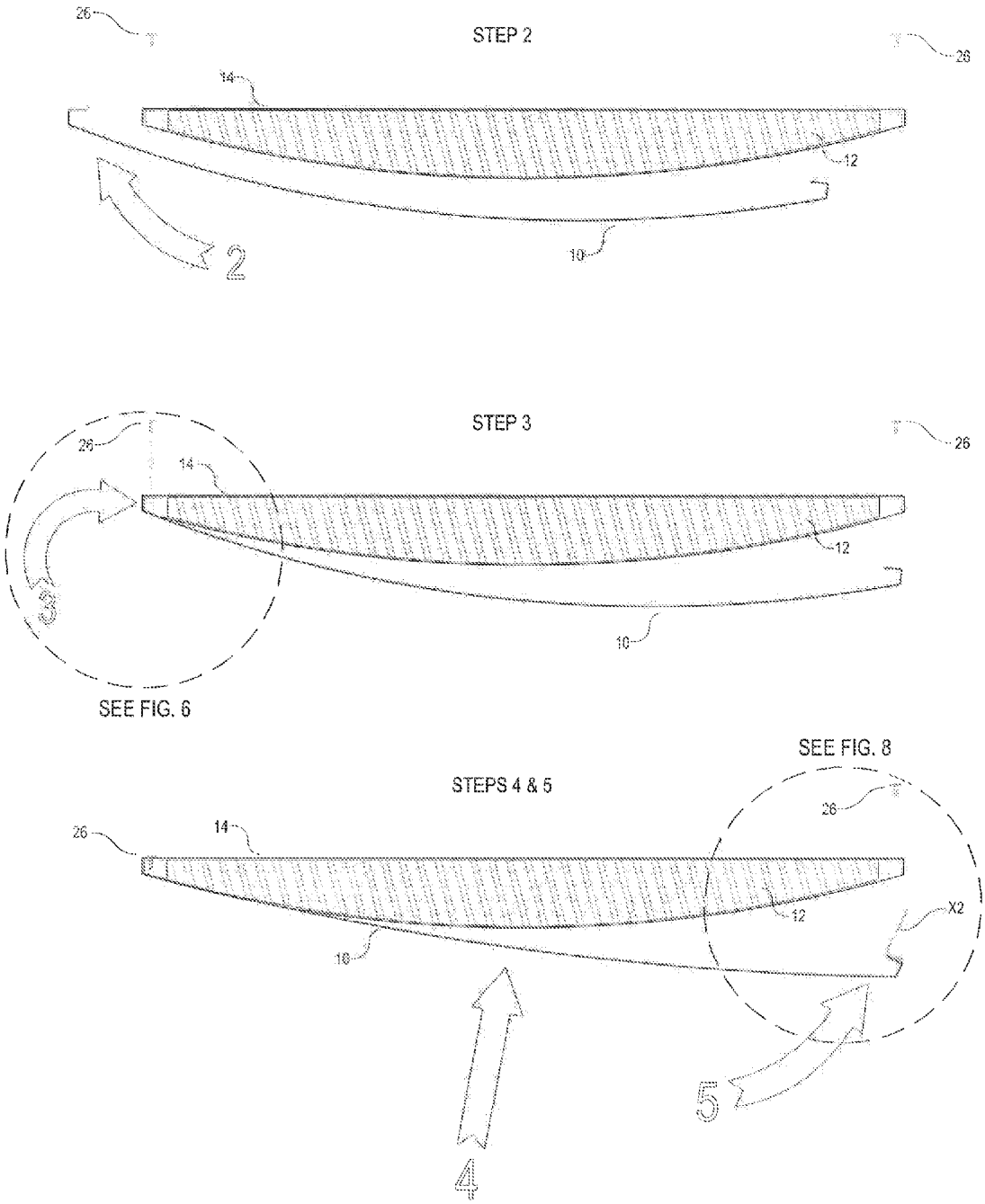
Figure 5C:
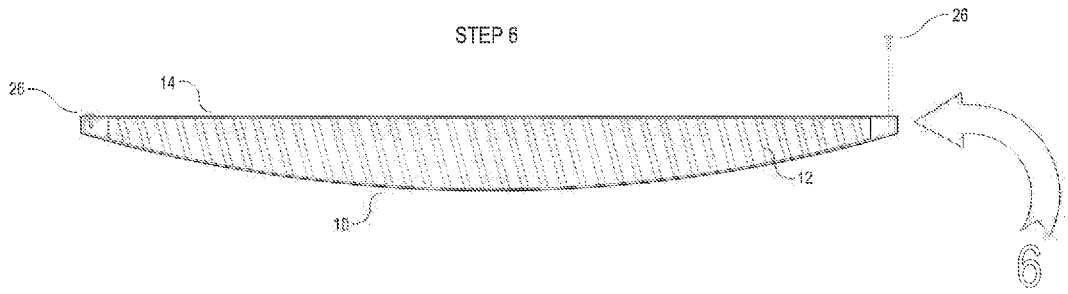
Figure 5C:
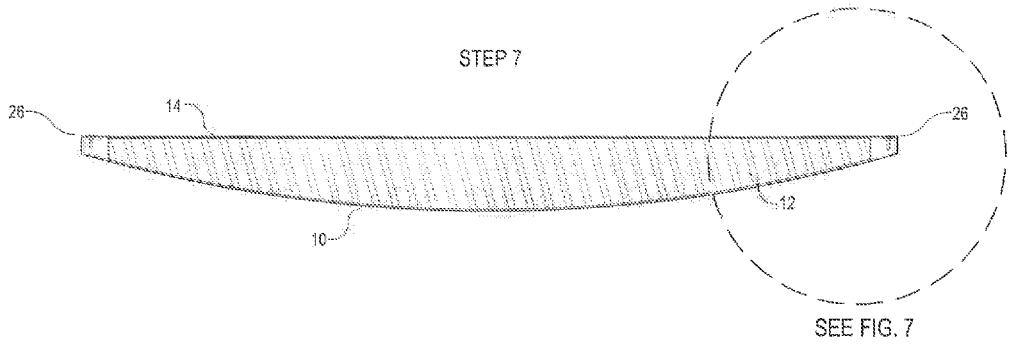
Figure 6:
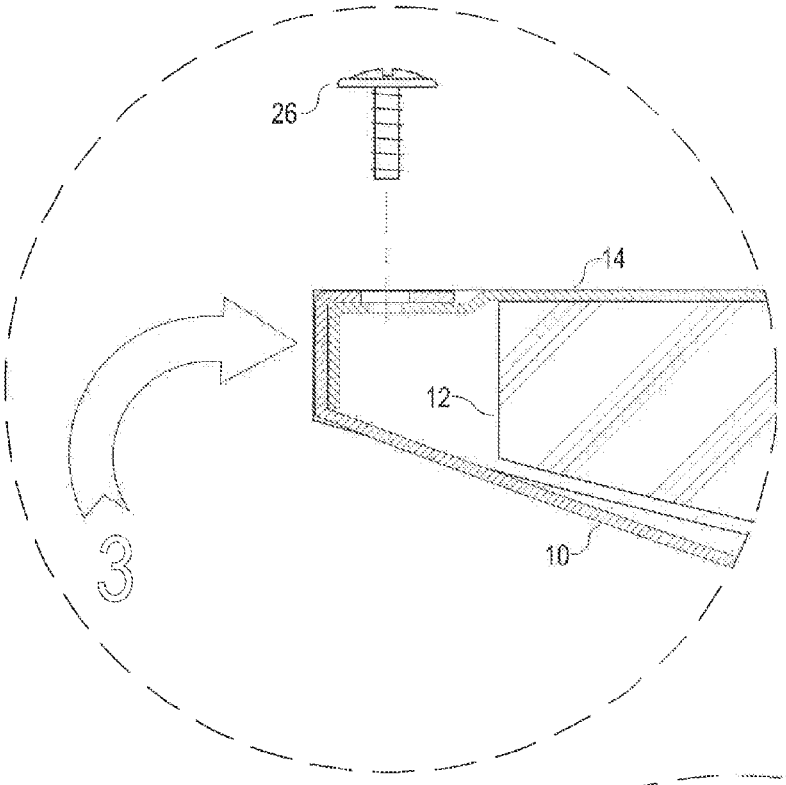
FIG. 6 illustrates an enlarged view of the step 3 of FIG. 5.
Figure 7:
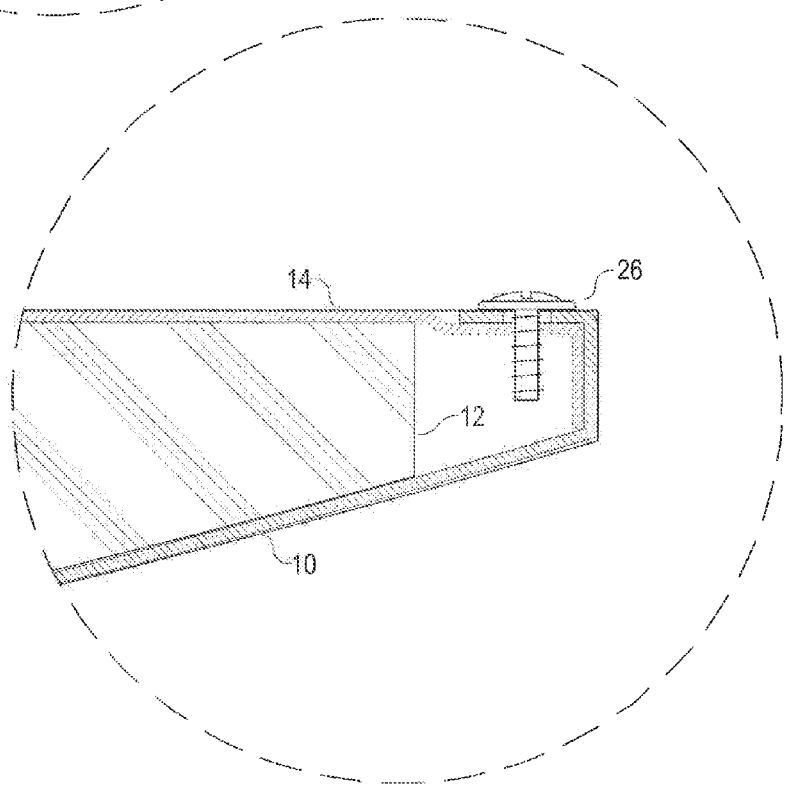
FIG. 7 illustrates an enlarged view of the step 7 of FIG. 5.

FIG. 6 illustrates an enlarged left-side sectional view of Step 3 (FIG. 5*b*) showing parked position of the left-side edge of the covering skin 10 to door/drawer chassis 14 with sandwiched reinforcement core 12 and fastening screw 26. FIG. 7 illustrates an enlarged right-side sectional view of Step 7 (FIG. 5*c*) showing the assembled covering skin 10 to the door/drawer chassis 14 with sandwiched reinforcement core 12 and secured fastening screw 26 in a completed and assembled state. FIG. 8 illustrates an enlarged right-side sectional view of step 5 (FIG. 5*b*) showing optional tool or handling device X2 temporarily deforming the right-side edge of the covering skin 10.

It is obvious that the foregoing embodiments of the invention are examples and can be varied in many ways. Such present or future variations are not to be regarded as a departure from the spirit and scope of the invention, and all such modifications as would be obvious to one skilled in the art are intended to be included within the scope of the following claims.

I claim:

1. A replaceable front panel system for use with a storage module, comprising:

a chassis having a back panel, two side panels, a top panel, and a bottom panel, wherein the panels define an open interior, wherein the back panel includes at least one embossed deformation for structural rigidity, and wherein each of the top and bottom panels include outwardly projecting single arch extending from one side panel to the other side panel that defines a curved shape;

a reinforcement core shaped to fit within and substantially fill the open interior and structurally support the chassis, wherein the reinforcement core includes a curved front face corresponding to the curved shape of the top and bottom panels; and a removable covering skin coupled to at least the two side panels, thereby enclosing the reinforcement core within the open interior of the chassis, wherein the removable covering skin is longer than a width of the chassis, and comprises wrap-around portions that each extend around at least one of the two side panels to couple to the back side of the back panel, and wherein the removable covering skin conforms to the curved shape of the top and bottom panels to define a contoured front face, and wherein the reinforcement core conforms to the shape of the covering skin to provide structural support to the covering skin.

2. The system according to claim 1, wherein the system is configured for use as a drawer front.

3. The system according to claim 1, wherein the system is configured for use as a cabinet door.

4. The system according to claim 1, wherein the removable covering skin is retained on the chassis via attachment means selected from the group consisting of screws, hook and loop fasteners, magnets and adhesive.

5. The system according to claim 1, wherein the removable covering skin is retained on the chassis via resilient bias.

6. The system according to claim 1, wherein the removable covering skin is manufactured from materials selected from the group consisting of painted carbon steel, painted perforated carbon steel, stainless-steel, aluminum, lacquered and natural carbon fibre, plastic, fiberglass, synthetic and semi-synthetic woven fabric materials, and wood veneers.

7. The system according to claim 1, wherein the reinforcement core is formed from expanded polystyrene, expanded polypropylene, injected polyurethane, natural or synthetic cork, plastic, fiberglass or wood.

8. The system according to claim 1, wherein the reinforcement core comprises multiple, separate core sections.

* * * * *